US006663370B1

(12) United States Patent
Simonds

(10) Patent No.: US 6,663,370 B1
(45) Date of Patent: Dec. 16, 2003

(54) CONDENSER MOTOR

(75) Inventor: Edward L. Simonds, Adel, IA (US)

(73) Assignee: Thermal Dynamics, Inc., Adel, IA (US)

( * ) Notice: Subject to any disclaimer, the term of this patent is extended or adjusted under 35 U.S.C. 154(b) by 0 days.

(21) Appl. No.: 09/878,747

(22) Filed: Jun. 11, 2001

(51) Int. Cl.[7] ..... F01C 1/344; F01C 21/06
(52) U.S. Cl. ..... 418/259; 418/264
(58) Field of Search ..... 418/264, 259

(56) References Cited

U.S. PATENT DOCUMENTS

| | | | | |
|---|---|---|---|---|
| 2,463,155 A | * | 3/1949 | Dawes | 418/137 |
| 3,804,562 A | | 4/1974 | Hansson | 418/259 |
| 4,347,705 A | | 9/1982 | Mirante | |
| 4,553,396 A | | 11/1985 | Heizer | |
| 4,628,212 A | | 12/1986 | Uehara et al. | |
| 4,789,317 A | | 12/1988 | Waser et al. | 418/259 |
| 5,284,427 A | | 2/1994 | Wacker | 418/83 |
| 5,501,586 A | * | 3/1996 | Edwards | 418/264 |
| 5,533,566 A | | 7/1996 | Fineblum | 418/83 |
| 5,548,958 A | | 8/1996 | Lewis | |
| 5,816,789 A | | 10/1998 | Johnson | 418/227 |
| 5,961,310 A | | 10/1999 | McClure | 418/248 |
| 6,024,549 A | | 2/2000 | Lee | 418/135 |
| 6,233,941 B1 | | 5/2001 | Youssef | |

* cited by examiner

*Primary Examiner*—John J. Vrablik
(74) *Attorney, Agent, or Firm*—Brett Trout

(57) ABSTRACT

A motor comprising a housing defining a chamber, a plate provided within said chamber, and means for condensing a gas within said housing in a manner which creates a sufficient negative pressure near said plate to assist in movement of said plate.

20 Claims, 9 Drawing Sheets

CONDENSER MOTOR

BACKGROUND OF THE INVENTION

1. Field of the Invention

The present invention relates in general to a condenser for converting a gas to a liquid and, more specifically, to a condenser capable of converting condensation of a gas into a liquid into available power.

2. Description of the Prior Art

Condensers for converting a gas into a liquid are generally known in the art. Prior art condensers are typically of the pressure type, or the radiator type, or a combination of the two.

In a pressure-type condenser, pressure is applied to a gas sufficient to convert the gas to a liquid. As pressure is applied, heat is generated, often requiring a supplemental system for removing the heat to more efficiently condense gas passing through the system.

In a radiator-type of condenser, a gas is passed through a container designed to maximize the surface area contact of the container with a gas. Such containers are often provided with a plurality of tubes, passing through an air circulation system, such as a fan, to increase the surface area available for contact with the gas, and more efficiently remove heat from the surfaces of the tubes. Such prior art systems have several drawbacks.

One drawback associated with prior art condensers is that often a gas reaches a prior art condenser at a temperature significantly above its boiling point. Therefore, not only is additional energy required to reduce the temperature of the gas to its boiling point, but even more energy is required to condense the gas to a liquid. This requires a large condenser expending a significant amount of energy. Not only does the excess heat energy contained within the gas require additional energy for its removal, the excess heat energy is actually wasted by not being converted to work. This reduces the overall efficiency of the system.

It would, therefore, be desirable in such prior art systems to convert a substantial portion of the gas to a liquid, prior to reaching a condenser, and to extract work from a gas during its condensation to a liquid.

The difficulties encountered in the prior art discussed hereinabove are substantially eliminated by the present invention.

SUMMARY OF THE INVENTION

In an advantage provided by this invention, a condenser extracts work from a gas during the condensation process.

Advantageously, this invention reduces the amount of energy required to condense a gas in a condensation system.

Advantageously, this invention provides for the use of a smaller prior art condenser, thereby reducing, cost, weight and maintenance associated with a larger condenser.

Advantageously, this invention extracts work from condensing gas.

Advantageously, this invention provides a self-contained cooling system for increasing the efficiency with which work may be extracted from a condensing gas.

Advantageously, in a preferred example of this invention, a motor is provided, comprising a housing defining a chamber, a plate provided within the chamber, and means for condensing the gas within the housing in a manner which applies force to the plate. Gas is condensed within the motor to create negative pressure in a manner that generates work.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
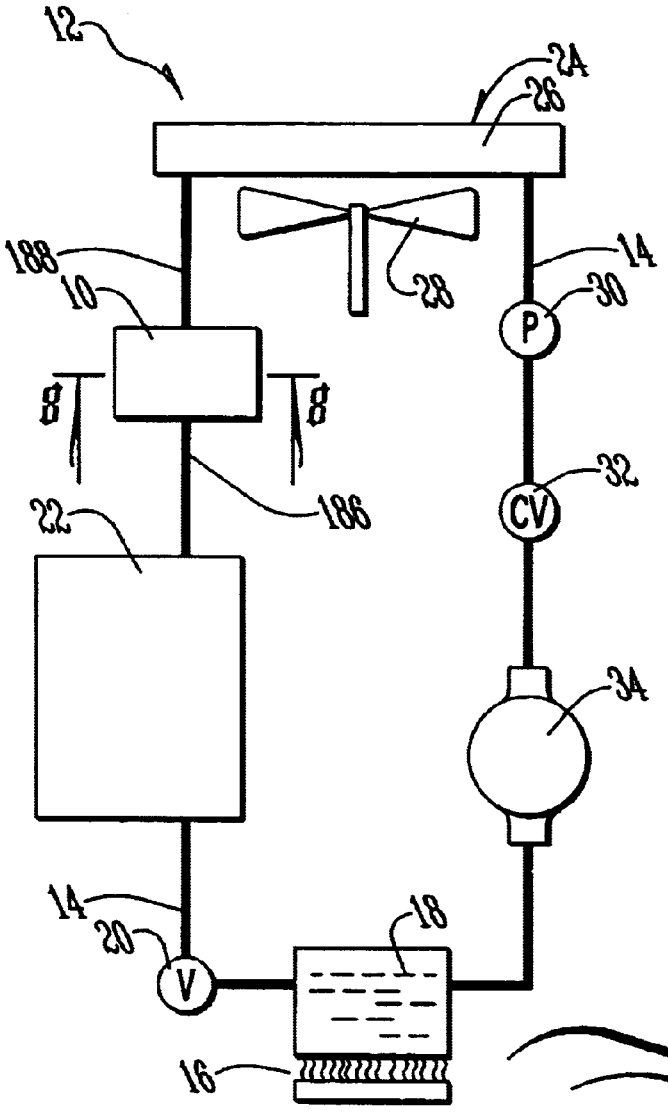
FIG. 1 illustrates a top plan view of the condensation assembly utilized in association with the condenser motor of the present invention.

Referring to FIG. 1, a condenser (10) according to this invention is shown as part of a fluid condensing apparatus (12). The fluid condensing apparatus (12) includes several lengths of insulated pipe (14), which may be constructed of copper, stainless steel, or any suitable material known in the art.

The fluid condensing apparatus (12) is provided with a heater (16), capable of heating a fluid such as water (18). Of course, the fluid may be any suitable fluid known in the art. The heater (16) is coupled by insulated pipe (14) to an injection control valve (20). In the preferred embodiment, the injection control valve (20) is a valve manufactured by Thermal Dynamics of Adel, IA. The injection control valve (20) is coupled by insulated pipe (14) to a fluid motor (22), such as the variable stroke motor described in U.S. Pat. No. 5,974,945 and incorporated herein by reference, or any other fluid driven motor known in the art. The fluid motor (22) is coupled by insulated pipe (14) to the condenser (10), which, in turn, is coupled to a prior art condenser (24) comprising a radiator (26) and a fan (28). The prior art condenser (24) is coupled by insulated pipe (14) to a fluid pump (30), a back flow check valve (32) and an accumulator (34), such as those well known in the art.

Figure 2:
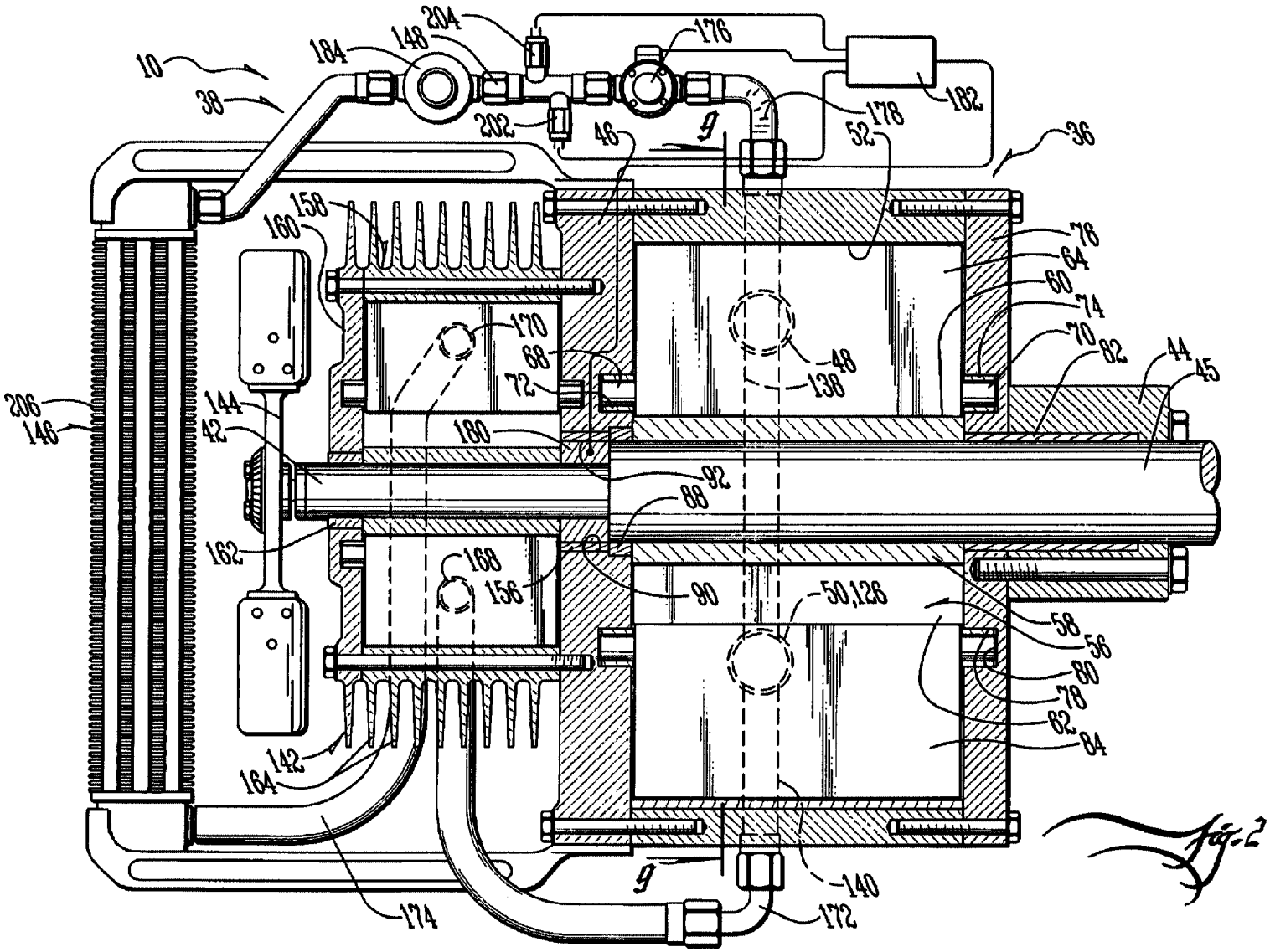
FIG. 2 illustrates a partial phantom bottom view in cross-section of the condenser of the present invention.
Figure 3:
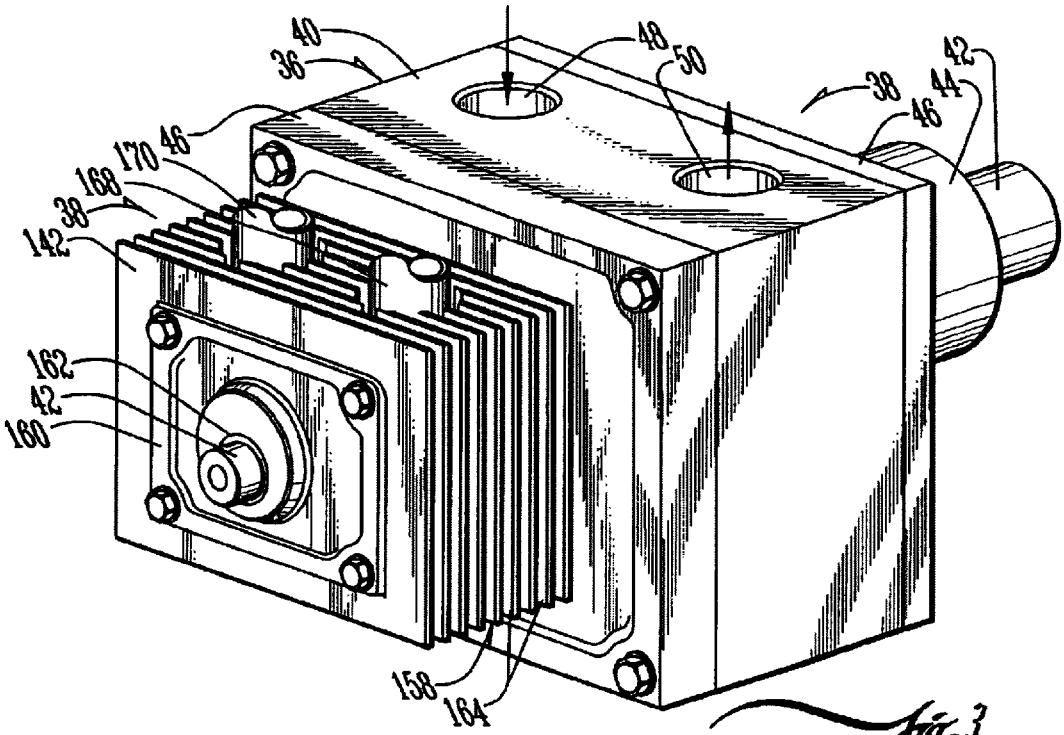
FIG. 3 illustrates a front perspective view of the condenser of FIG. 1.

As shown in FIG. 2, the condenser (10) comprises a motor (36) and a cooling system (38). As shown in FIG. 3, the motor (36) and cooling system (38) are contained within a housing (40). The housing (40) may be constructed of stainless steel or any other suitable material. As shown in FIGS. 2 and 3, the motor (36) includes a driveshaft (42) coupled to the housing (40) by a bushing (44). The bushing (44) is secured to the housing (40) by bolts or similar securement means. The driveshaft (42), in turn, is coupled to a compressor drive shaft (45).

Figure 4:
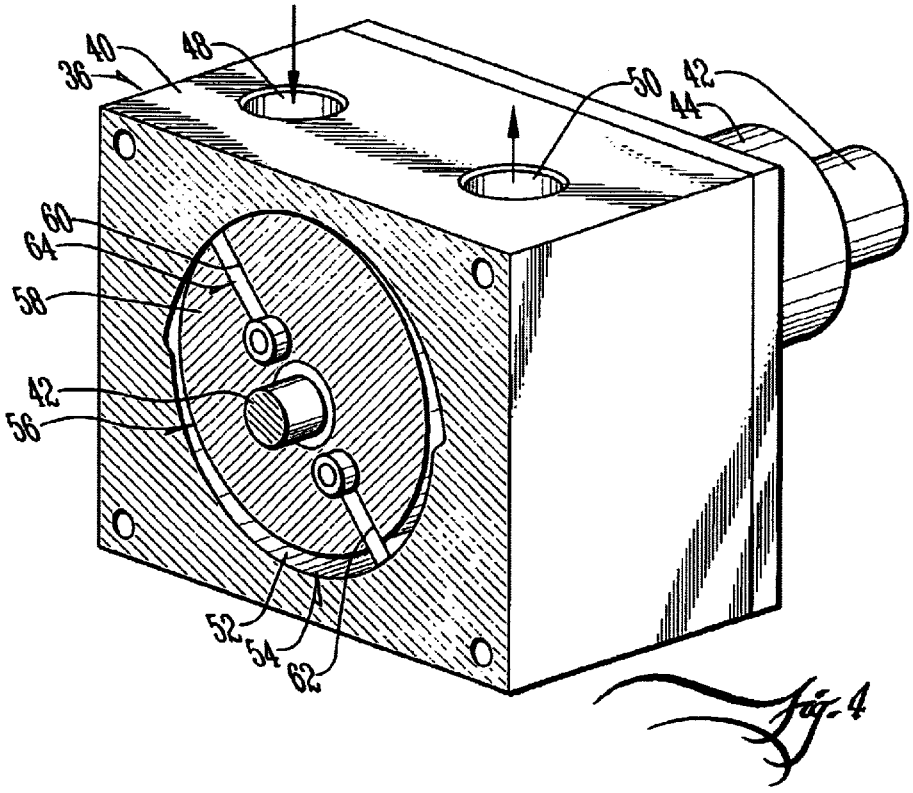
FIG. 4 illustrates a rear perspective view of the condenser of FIG. 1, shown with the cooling assembly removed.

FIG. 4 shows the motor (36) with the cooling system (38) and divider plate (46) removed. (FIGS. 2 and 4). The motor (36) is provided with a fluid inlet (48) and a fluid outlet (50). The housing (40) includes an outer wall (52), defining a hollow interior (54). Provided within the hollow interior (54) is a revolver, which, in the preferred embodiment, is a drum (56), comprising a solid cylinder (58) having a first slot (60) and a second slot (62). The cylinder (58) is welded or otherwise coupled to the driveshaft (42), which extends through the center of the cylinder (58). While the slots (60) and (62) may be of any suitable dimensions, in the preferred embodiment, the slots (60) and (62) are of a symmetrical design and of a constant width, extending across the entire length of the cylinder (58). Provided within the first slot (60) is a plate (63) such as a first vane (64). The plate (63) may, of course, be a piston, a curved vane, or any other movable structure known in the art to translate pressure into work.

Figure 5:
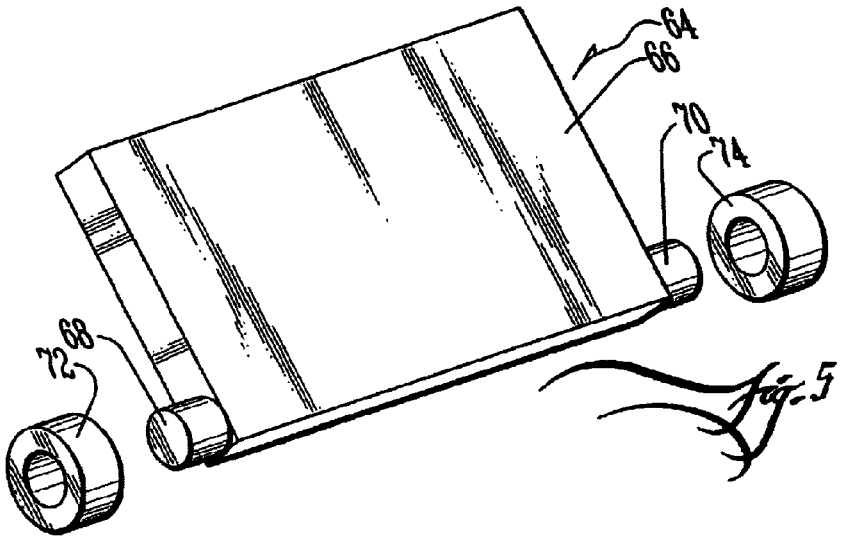
FIG. 5 illustrates a side perspective view of the first vane of the motor of the present invention.

As shown in FIG. 5, in the preferred embodiment, the first vane (64) comprises a rectangular block (66) of stainless steel or similarly rigid material. Secured laterally to the lower end of the block (66) are ears (68) and (70). Preferably the block (66) and ears (68) and (70) are formed of a single piece of stainless steel. The ears (68) and (70) are preferably cylindrical, and each provided with a bearing (72) and (74).

Figure 6:
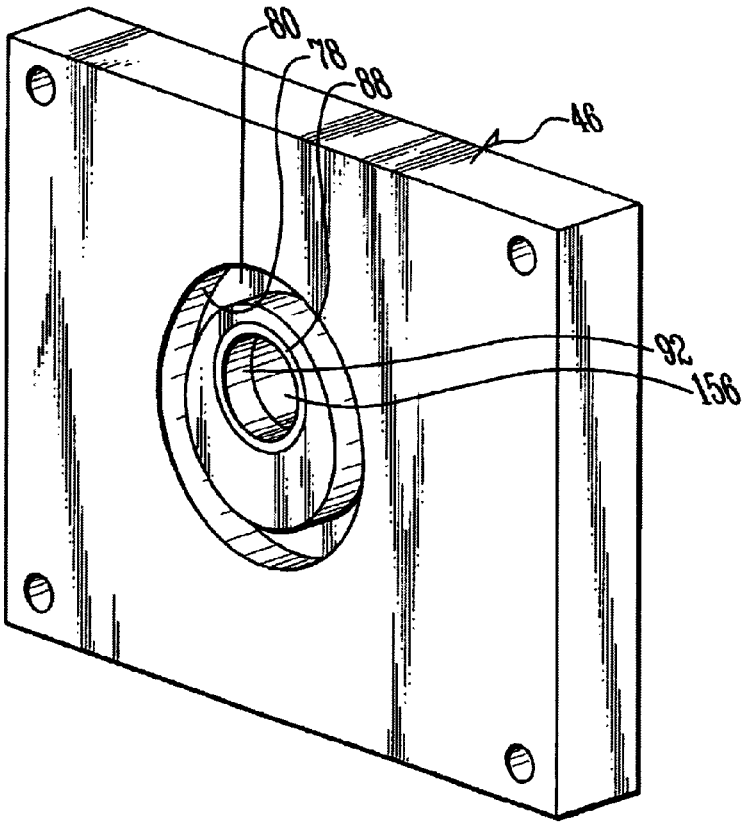
FIG. 6 illustrates a side perspective view of the divider plate of the motor of the present invention.

The housing (40) also comprises a front plate (76), which, along with the divider plate (46) is secured over the hollow interior (54) by bolts or similar securement means. (FIGS. 3 and 4). As shown in FIG. 6, the divider plate (46) is provided with an elliptical groove (78) surrounding a circular throughbore (80). The width and depth of the elliptical groove (78) are slightly greater than the dimensions of the second bearing (74) which rides therein. (FIG. 5–6). Provided within the throughbore (80) is a bushing (82) having an outer diameter substantially similar to the diameter of the throughbore (80) and an inner diameter substantially similar to that of the driveshaft (42). (FIGS. 3 and 6). Although the elliptical groove (78) may be of any suitable depth, in the preferred embodiment it is two centimeters in depth, with the depth of the divider plate (46) being four centimeters.

Figure 7:
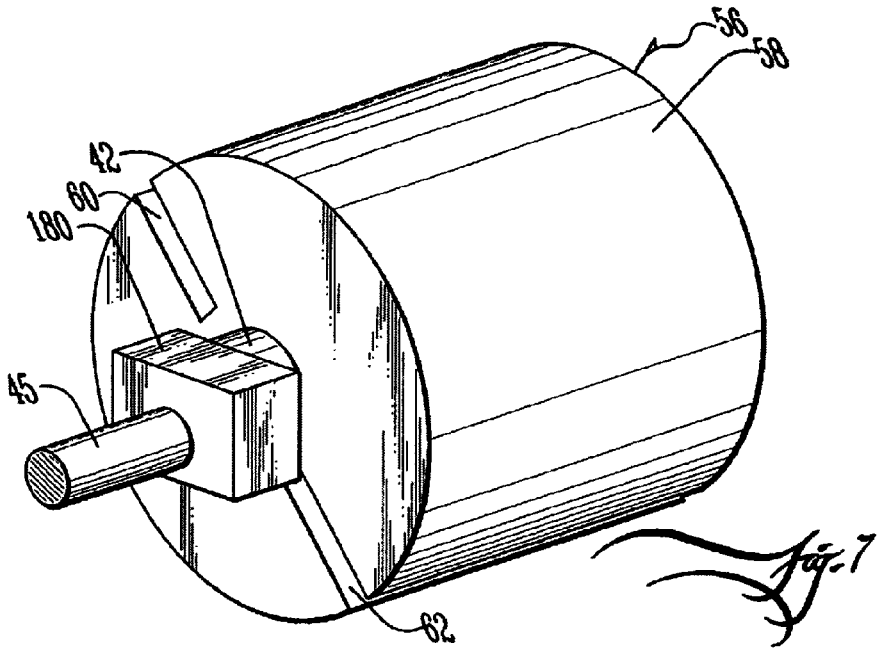
FIG. 7 illustrates a rear perspective view of the cylinder and gearbox of the present invention.
Figure 8:
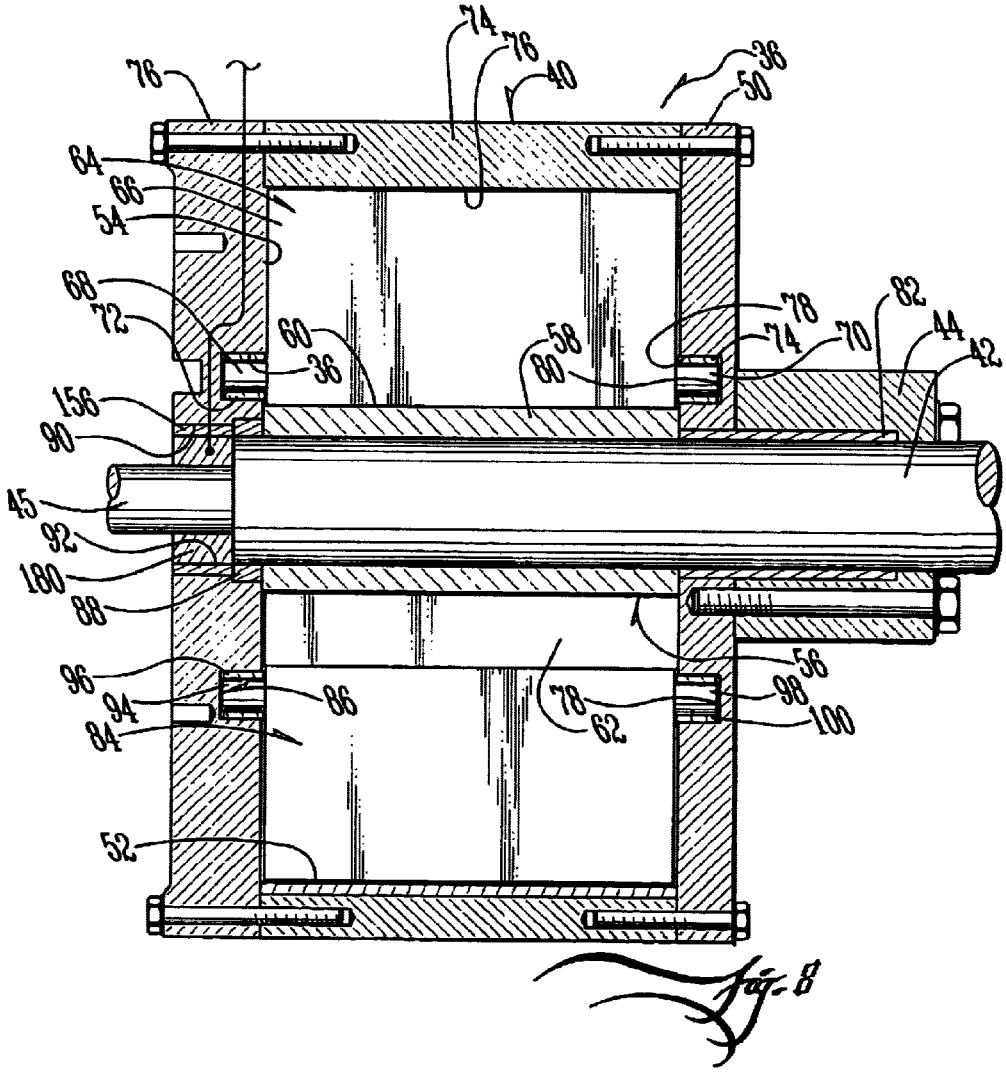
FIG. 8 illustrates a partial phantom side elevation in cross-section of the motor of the condenser of the present invention, taken along Line 6—6 of FIG. 1.

As shown in FIG. 7, the slots (60) and (62) of the cylinder (58) are sized to provide slidable movement of the first vane (64) and a second vane (84) within the slots (60) and (62), relative to the cylinder (58). (FIGS. 7 and 8). As shown in FIG. 8, the front plate (76) is also provided with an elliptical groove (86) and a bushing (88). The front plate (76) is also provided with a throughbore (90), containing a bushing (88) and an open center (92), which allows the driveshaft (42) to pass through the front plate (76). Provided within the elliptical groove (86) is the first bearing (72) provided around the first ear (68). As shown in FIG. 8, the second vane (84) is provided with a third ear (94) and a third bearing (96), provided within the elliptical groove (86) of the front plate (76), and a fourth ear (98) and a fourth bearing (100), provided within the elliptical groove (78) of the divider plate (46).

Figure 9:
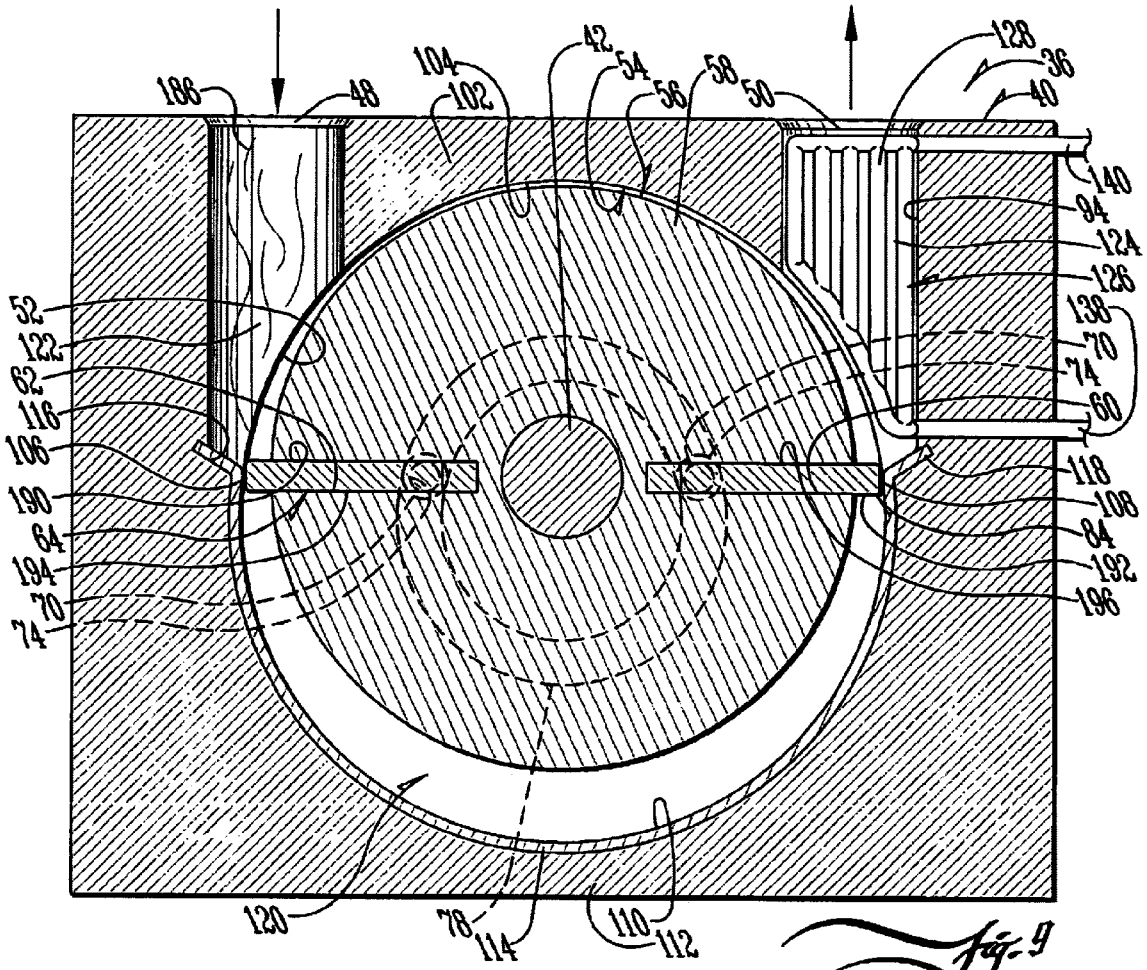
FIG. 9 illustrates a partial phantom front elevation in cross-section of the motor of the present invention taken along Line 9—9 of FIG. 2.

As shown in FIG. 9, the housing (40) is provided with a ceiling (102) having an inner face (104) of a curvature substantially similar to that of the cylinder (58). The cylinder (58) is preferably positioned within five millimeters of, and, more preferably, within one millimeter of the inner face (104) of the ceiling (102). The cylinder (58) is preferably positioned no closer than one one-hundredth of a millimeter, and, more preferably no closer than one-tenth of a millimeter to the inner face (104) of the ceiling (102). In the preferred embodiment, the tips (106) and (108) of the vanes (64) and (84) are constructed of titanium or other abrasion-resistant material to reduce damage associated with particulate (not shown) passing between the tips (106) and (108) and the housing (40) of the motor (36).

As shown in FIG. 9, the outer wall (52) includes not only the face (104) of the ceiling (102), but a face (110) of a floor (112) of the housing (40) as well. The face (110) of the floor (112) is provided with an abrasion plate (114), preferably constructed of titanium or similar abrasion-resistant material. As shown, the housing (40) is provided with a first slot (116) and a second slot (118) to which the ends of the abrasion plate (114) are friction fit. Although the face (110) of the floor (112) may be of any suitable dimensions, in the preferred embodiment the cylinder (58) is of a tighter radius than that of the preferably constant radius of the face (110) of the floor (112). The distance between the cylinder (58) and the abrasion plate (114) is preferably between fifty percent and ninety-five percent of the height of the vanes (64) and (84).

Figure 10:
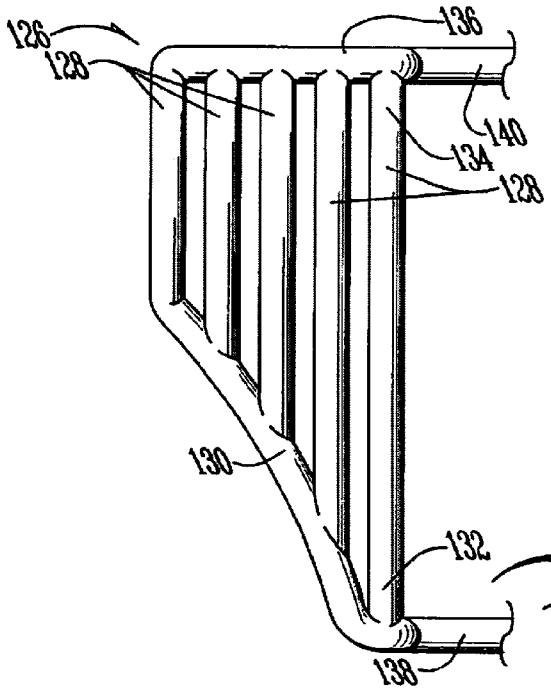
FIG. 10 illustrates a side elevation of the heat exchanger of the present invention
Figure 11:
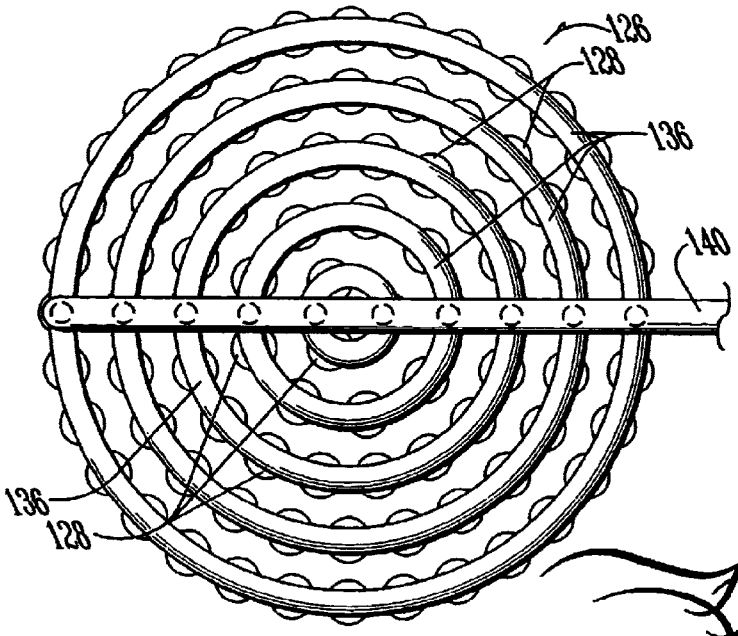
FIG. 11 illustrates a top elevation of the heat exchanger of FIG. 10.

As shown in FIG. 9, the housing (40) defines a chamber (120). The chamber (120) includes an expansion chamber (122) in fluid communication with the fluid inlet (48) and a condensation chamber (124) in fluid communication with both the fluid outlet (50) and the expansion chamber (122). As shown in FIG. 9, provided within the condensation chamber (124) is a heat exchanger (126). As shown in FIGS. 10 and 11, the heat exchanger (126) comprises a plurality of exchange tubes (128). In the preferred embodiment, the exchange tubes (128) are constructed of thin-walled aluminum. The exchange tubes (128) may, of course, be constructed of any suitable material, preferably designed to increase the surface area of the exchange tubes (128) within the interior of the condensation chamber (124). As shown in FIG. 10, the exchange tubes (128) are of varying lengths, to accommodate the dimensions of the condensation chamber (124), shown in FIG. 9. Of course, the exchange tubes (128) may be constructed of any desired dimensions. The exchange tubes (128) are preferably provided with lower link tubes (130) in fluid communication with the bottoms (132) of the exchange tubes (128). Similarly, the tops (134) of the exchange tubes (128) are coupled into fluid communication with upper link tubes (136). Preferably lower link tubes (130) and upper link tubes (136) are constructed of thin-walled aluminum and allow fluid to circulate evenly through the exchange tubes (128). As shown in FIG. 10, the lower link tubes (130) are coupled into fluid communication with an inlet (138) and the upper link tubes (136) are coupled into fluid communication with an exhaust (140). As shown in FIG. 9, the heat exchanger (126) may rest on the abrasion plate (114), or may instead be friction fit or otherwise secured into the condensation chamber (124).

As shown in FIG. 2, the cooling system (38) is coupled to the divider plate (46) of the motor (36) by bolts or similar securement means. As shown in FIG. 2, the cooling system (38) is provided with a compressor (142) substantially similar to the motor (36), albeit on a smaller scale. In the preferred embodiment, the components of the compressor (142) are twenty-five percent of the dimensions of the motor (36) but may, of course, be of any suitable dimensions relative to the motor (36), including, but not limited to, being larger than the components of the motor (36). As shown in FIG. 2, the cooling system (38) comprises the compressor (142), a fan blade (144) coupled to the compressor driveshaft (45), a radiator (146), and insulated tubing (148).

Figure 12:
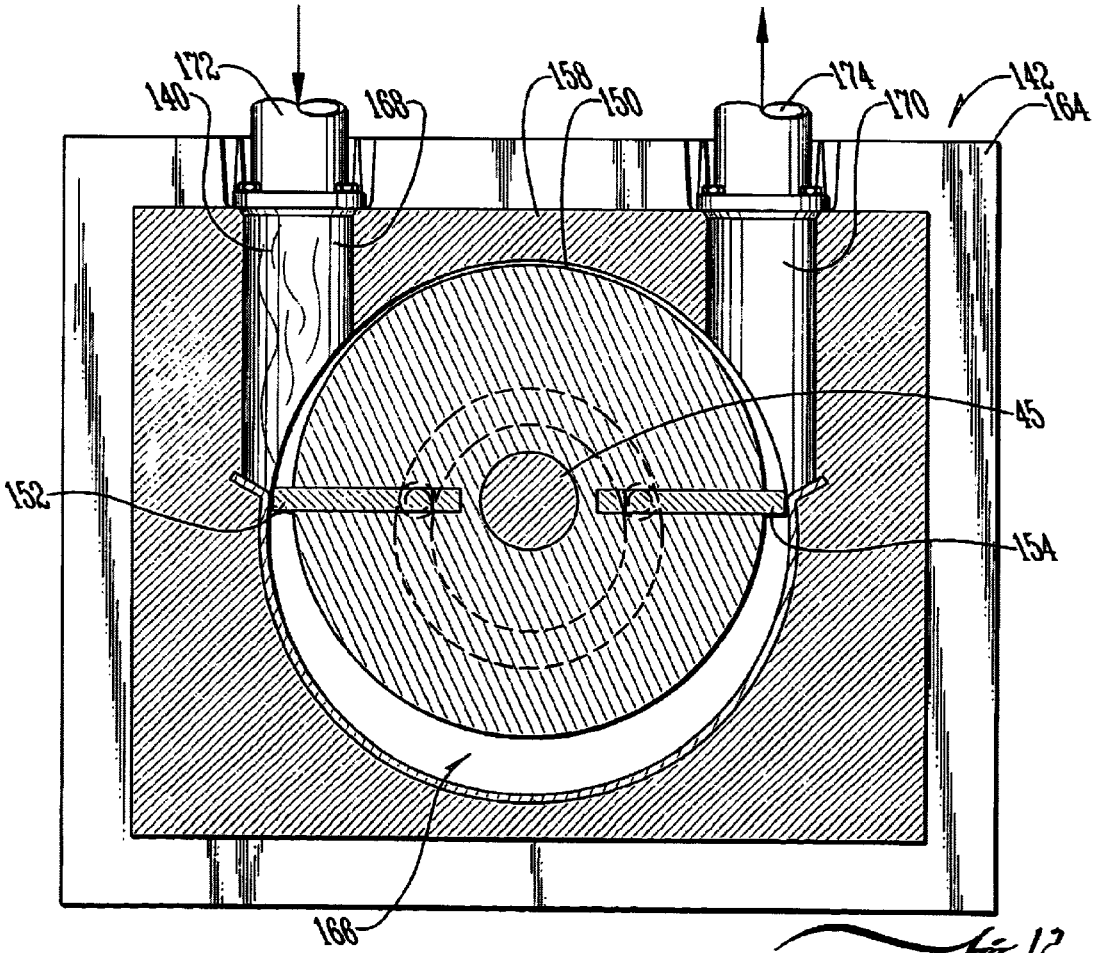
FIG. 12 illustrates a partial phantom front elevation in cross section of a portion of the cooling system compressor of the present invention.

As shown in FIG. 12, the compressor (142) is constructed in a manner similar to that described above in relationship to the motor (36), albeit on a smaller scale. As shown in FIG. 12, the compressor (142) comprises a drum (150), provided with a first vane (152) and second vane (154). The drum (150) is provided around the compressor driveshaft (45), which, as shown in FIG. 2, is journaled within a bushing (156) provided within the divider plate (46). Also shown in FIG. 2, the compressor driveshaft (45) extending through the compressor (142) is of a narrower diameter than the driveshaft (42) passing through the motor (36). Preferably the compressor driveshaft (45) is one-half the diameter of the driveshaft (42) passing through the motor (36).

The compressor (142) is provided with a housing (158) and a back plate (160), which is bolted or otherwise secured to the housing (158). The back plate (160) is provided with a bushing (162), through which the compressor driveshaft (45) is secured. As shown in FIG. 12, the housing (158) is preferably provided with aluminum fins (164), such as those well known in the art, to dissipate heat away from the housing (158). The compressor (142) is also provided with a chamber (166), divided into an input chamber (168) and a compression chamber (170) (FIG. 12). As shown in FIGS. 2, 9 and 12, the exhaust (140) of the heat exchanger (126) is coupled into fluid communication with the input chamber (168) of the compressor (142) by high pressure tubing (172). Similarly, the compression chamber (170) is coupled into fluid communication with the radiator (146) by an additional piece of high pressure tubing (174). The radiator (146) is coupled into fluid communication with the inlet (138) of the heat exchanger (126). As shown in FIG. 2, a valve (176), which is, in the preferred embodiment, an expansion valve, manufactured by Thermal Dynamics of Adel, IA, or any other similar valve known in the art of fluid compression and expansion systems, is provided to provide a sufficient amount of back pressure to allow a fluid (178), such as dichlorodifluoromethane, provided in the cooling system, to liquefy prior to entering the heat exchanger (126).

As shown in FIG. 2, the driveshaft (42) is provided with a gearbox (180), such as those known in the art, to engage and disengage the compressor driveshaft (45) coupled to the fan blade (144), depending on the cooling requirement of the radiator (146). As shown in FIG. 2, the gearbox (180) is coupled to an electronic control mechanism (182), capable of signaling the gearbox (180) to either engage or disengage the compressor driveshaft (45), or to increase or decrease rotation of the compressor driveshaft (45) relative to the driveshaft (42) extending into the motor (36). The cooling system (38) is also provided with an accumulator (184) coupled between the radiator (146) and the heat exchanger (126) to store fluid (178) which has passed through the compressor (142) and radiator (146).

To operate the fluid condensing apparatus (12) in accordance with the present invention, the heater (16) is actuated to heat the water (18) to a temperature of two hundred fifty degrees Celsius, at a pressure of three hundred pounds per square inch. (FIG. 1) The injection control valve (20) is actuated to allow the hot water (18) into the fluid motor (22), where the fluid motor (22) converts the pressurized water (18) into pressurized steam, and the pressurized steam into work. Thereafter, the water (18) exits the fluid motor (22) and enters the condenser (10). The water (18) enters the condenser (10) in the form of liquid water (186) at a temperature of one hundred degrees Celsius, and steam (188), at a temperature of one hundred and two degrees Celsius. As the liquid water (186) and steam (188) enter the inlet (48) of the motor (36), the pressurized steam (188) presses against a face (190) of the first vane (64), forcing the first vane (64) and cylinder (58) into a counterclockwise rotation. The pressurized steam (188) continues to expand and to press on the face (190) of the first vane (64) until the vanes (64) and (84) are in the orientation shown in FIG. 13.

Figure 13:
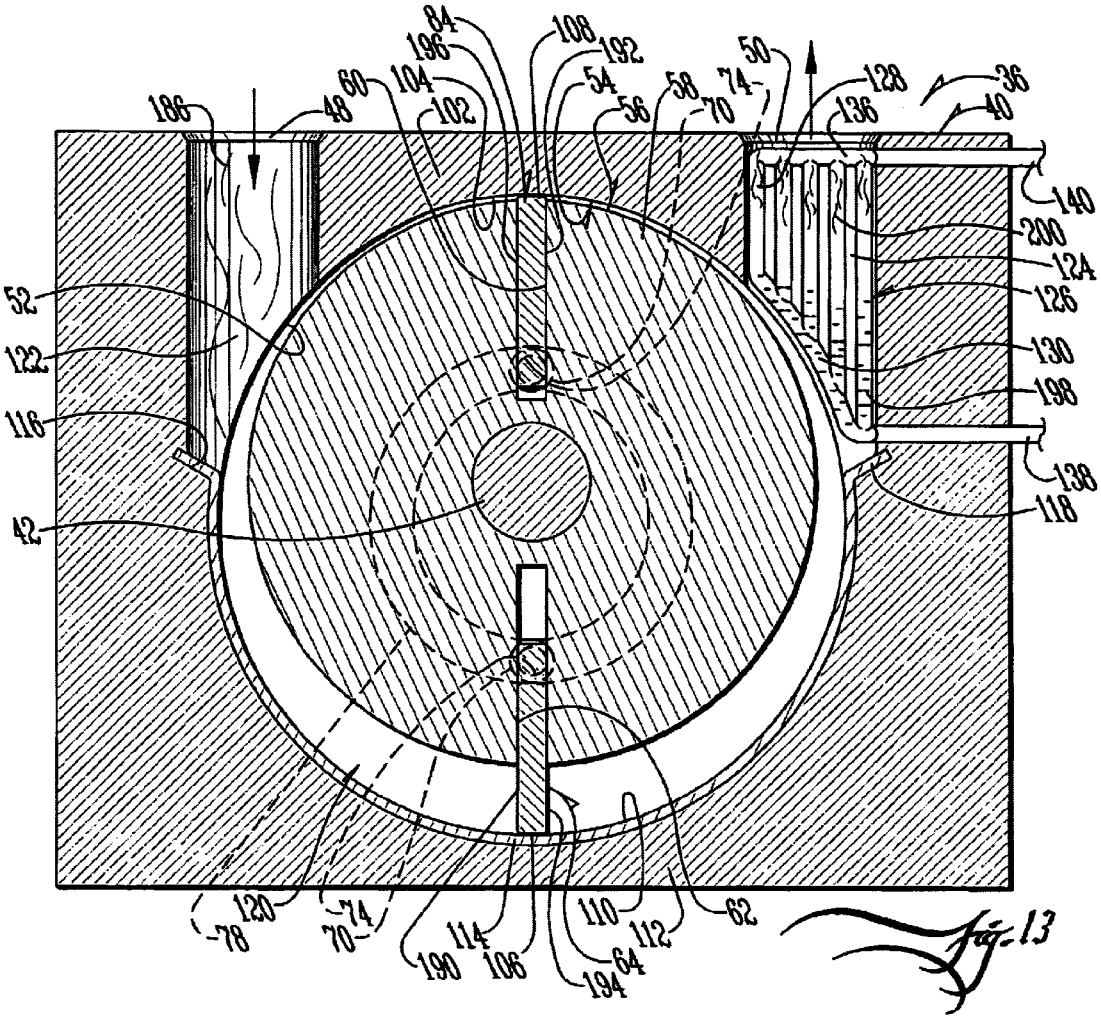
FIG. 13 illustrates the motor of FIG. 9, shown with the vanes rotated ninety degrees.

As shown in the drawings, the elliptical grooves (78) and (86) guide the bearings (72), (74), (96) and (100) along a path sufficient to maintain the tips (106) and (108) of the vanes (64) and (84) near, but just out of contact with, the inner face (104) of the ceiling (102) and the abrasion plate (114). (FIGS. 8 and 13). As shown in FIG. 13, when the first vane (64) is nearly fully extended out of the first slot (60), the second vane (84) is retracted into the second slot (62). The amount of the second vane (84) exposed to the pressurized steam (188) is, therefore, reduced, as is its drag coefficient. If the second vane (84) were instead extended, it would have a larger drag coefficient, and would allow the pressurized steam (188) to force the cylinder (58) toward a clockwise rotation, reducing the efficiency of the motor (36).

As shown in FIG. 13, as the pressurized steam (188) presses against the face (190) of the first vane (64), the tip (106) of the first vane (64) moves along the abrasion plate (114). The gap between the tip (106) of the first vane (64) and the abrasion plate (114) is preferably less than five millimeters, and, more preferably, less than one millimeter; while being preferably greater than one one-hundredth of a millimeter, and more preferably, more than one fiftieth of a millimeter in length.

Figure 14:
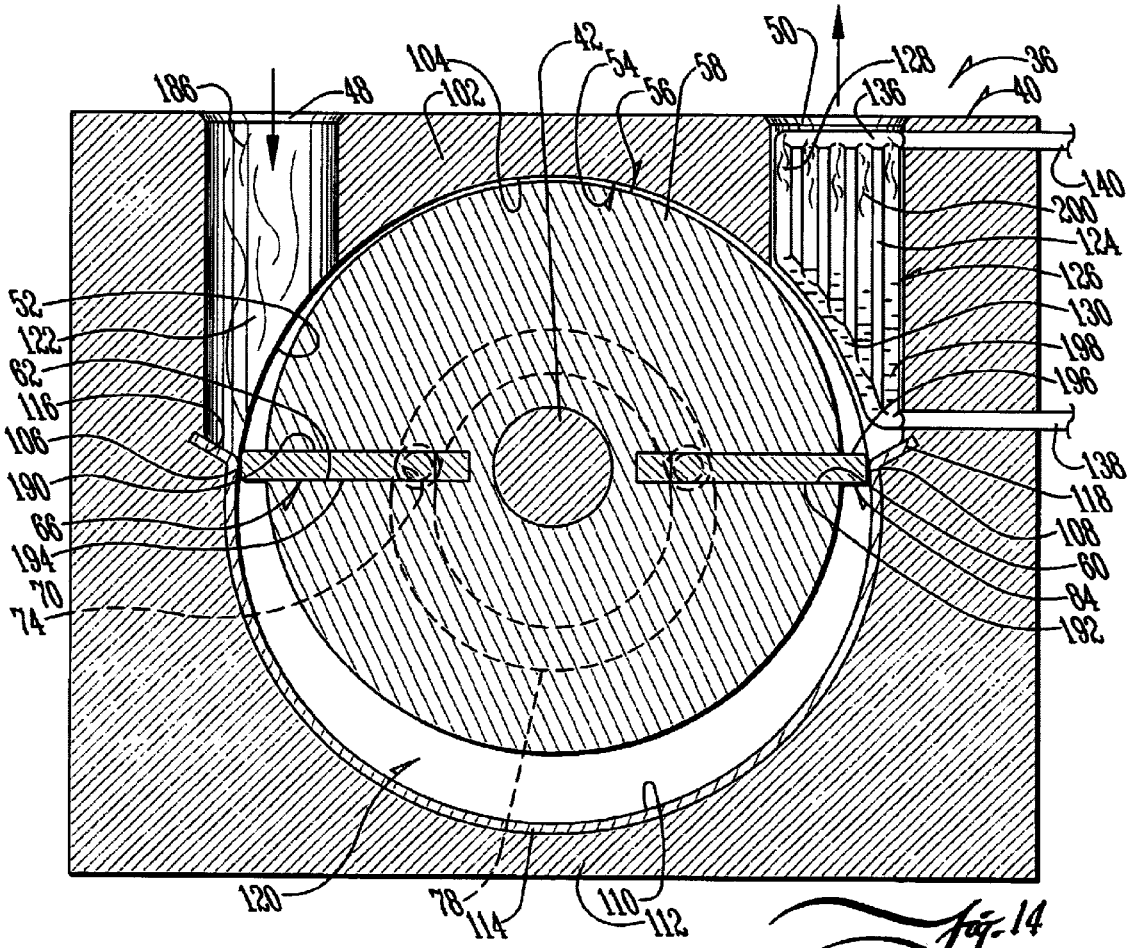
FIG. 14 illustrates the motor of FIG. 9, shown with the vanes rotated one hundred eighty degrees.

As the pressurized steam (188) presses against the face (190) of the first vane (64), the first vane (64) rotates the cylinder (58) and driveshaft (12). As the cylinder (58) rotates toward the orientation shown in FIG. 14, the elliptical grooves (78) and (86) force the bearings (96) and (100) to move the second vane (84) out of the second slot (62) to expose a face (192) of the second vane (84) to the pressurized steam (188). (FIGS. 8 and 14). Similarly, the elliptical grooves (78) and (86) guide the bearings (72) and (74) of the first vane (64) to retract the first vane (64) into the first slot (60), thereby reducing the amount of the face (190) of the first vane (64) exposed to the pressurized steam (188) (FIGS. 8 and 14). This cycle continues with the elliptical groove (78) of the divider plate (46) and elliptical groove (86) of the front plate (76), guiding the bearings (72), (74), (96) and (100) to extend and retract the first vane (64) and second vane (84), reducing the exposure of the faces (190) and (192) of the vanes (64) and (84) as they pass the inner face (104) of the ceiling (102), and increasing the exposure of the faces (190) and (192) of the vanes (64) and (84) as they pass the abrasion plate (1 14).

The elliptical grooves (78) and (86) also prevent the tips (106) and (108) of the vanes (64) and (84) from contacting the housing (40) or the abrasion plate (114), which would cause friction, reducing both the efficiency and life span of the motor (36). As the vanes (64) and (84) move past the abrasion plate (114), the pressurized steam (188) enters the condensation chamber (124). (FIG. 14). As shown in FIG. 14, as the pressurized steam (188) enters the heat exchanger (126) provided in the condensation chamber (124), the pressurized steam (188) contacts the exchange tubes (128) which extract heat from, and thereby condense, the steam (188) into liquid water (186).

As the steam (188) condenses to liquid water (186), the volume of the steam (188) is reduced, thereby creating a negative pressure within the condensation chamber (124). This negative pressure exerts a counterclockwise force on a rear face (194) of the first vane (64), and a rear face (196) of the second vane (84) as the cylinder (58) rotates. In the preferred embodiment of the present invention, the motor (36) converts at least fifty percent, more preferably seventy-five percent, and most preferably ninety percent, of the steam (188) entering the motor (36) into liquid water (186) before the water (186) exits the condensation chamber (124) and passes to the prior art condenser (24) through the insulated pipe (14). (FIGS. 1 and 14). Preferably, the low pressure generated by the condensing steam (188) provides at least ten percent, more preferably at least twenty-five percent, and most preferably at least forty percent of the work required to rotate the drive shaft.

To condense the steam (188) within the condensation chamber (124), the exchange tubes (124) allow heat to pass from the steam (188) into the fluid (178) passing within the exchange tubes (128). In the preferred embodiment, the fluid (178) within the exchange tubes (128) is a liquid (198) as it enters the heat exchanger (126) and is converted to a gas (200), as the fluid (178) moves through the heat exchanger (126) and extracts heat from the steam (188) within the condensation chamber (124). From the heat exchanger (126), the gas (200) passes through the upper link tubes (136) and out the exhaust (140) to pass through the high-pressure tubing (172) into the input chamber (168) of the compressor (142).

As the motor (36) turns the driveshaft (42), the compressor driveshaft (45) rotates the drum (150), causing the vanes (152) and (154) to rotate, alternately extending from, and retracting into, the drum (150). In the preferred embodiment, the valve (176) is set to maintain pressure in the cooling system (38) between the valve (176) and the compressor (142). Accordingly, as the drum (150) rotates, the vanes (152) and (154) push the gas (200) from an area of lower pressure, namely the input chamber (168), to an area of higher pressure, namely the compression chamber (170). As the gas (200) is compressed, it converts into a liquid and generates heat, some of which is preferably radiated out through the fins (164) secured to the compressor (142). The electronic control mechanism (182) is also preferably coupled to the valve (176) to open the valve (176) more or less, and to increase, decrease or stop the rate of rotation of the compressor driveshaft (45) depending on the amount of liquid (198) required to cool the steam (188) passing through the condensation chamber (142) of the motor (36).

In the preferred embodiment, the electronic control mechanism (182) is part of a personal computer (201) coupled to a plurality of pressure gauges (202) and temperature gauges (204) provided at different areas throughout the condenser (10). The personal computer (201) is programmed to automatically condense more gas (200) into liquid (198) upon receipt of information from the pressure gauges (202) and temperature gauges (204), indicating that predetermined set points have been reached, and it is desired to produce more or less liquid (198), or to stop production of the liquid (198) all together.

As the rotating vanes (152) and (154) continue to convert the gas (200) into a liquid (198), the liquid (198) exits the compression chamber (170) and passes through the high-pressure tubing (174), into the radiator (146). As shown in FIG. 2, the radiator (146) is preferably provided with fins (206) in a manner such as that well known in the art. The radiator (146) and fins (206) are preferably positioned relative to the fan blade (144) in an orientation which allows the fan blades (144) to cool the radiator (146). As the compressor driveshaft (45) rotates, the fan blades (144) circulate air over the fins (206) of the radiator (146), removing heat from the liquid (198) passing through the radiator (146). As the liquid (198) cools, it moves out of the radiator (146) into the accumulator (184), where it remains until the personal computer (201) opens the valve (176) opens sufficiently to return the liquid (198) to the inlet (138) of the heat exchanger (126), whereafter the process described hereinabove is repeated.

As the fluid (178) circulates through the cooling system (38), the steam (188) passing through the motor (36) condenses to liquid water (186), causing a vacuum, which, along with the pressure of the steam (188) expanding in the expansion chamber (122), causes the vanes (64) and (84) to rotate in a counterclockwise manner, thereby translating expansion and condensation of the steam (188) into rotational motion of the driveshaft (42) which may be used to produce electricity, or for any other desired type of work.

Although the condenser (10) may be constructed of any suitable material, in the preferred embodiment, the housing (40) for the motor (36) and the housing (158) of the compressor (142) are constructed out of stainless steel, as are the vanes (64), (84), (152) and (154), and drums (56) and (150). High abrasion areas, such as the tips (106) and (108) of the vanes (64) and (84), and the abrasion plate (114), are constructed of titanium or similar abrasion resistant material. All of the other components are constructed from materials known in the art suitable for the purposes described herein. Of course, the condenser (10) may be constructed of aluminum, iron, brass, plastic or any other material known in the art, and may be constructed of any suitable configuration or dimensions, from several angstroms to several meters in length. Preferably, the condenser (10) is constructed of a block, approximately one cubic centimeter to one cubic meter in size, and, more preferably twenty-five cubic centimeters to one-half cubic meter in size. In the preferred embodiment, the first vane (64) is seven centimeters long, seven and one-half centimeters wide, and one centimeter thick. The diameter of the drum (56) is fifteen centimeters, and the distance between the inner face (104) of the ceiling (102) and the abrasion plate (114) along a line through the center of the drum (56) is sixteen and one-half centimeters.

Although the invention has been described with respect to a preferred embodiment hereof, it to be also understood that it is not so limited, since changes and modifications can be made therein which are within the full intended scope of this invention, as defined by the appended claims.

What is claimed is:

1. A motor comprising:

(a) a housing defining a chamber;

(b) a plate provided within said chamber; and (c) means for condensing a gas within said housing in a manner which creates a sufficient negative pressure near said plate to provide at least ten percent of the energy used to generate movement of said plate.

2. The motor of claim 1, wherein said condensing means is means for cooling said gas at least ten degrees Celsius.

3. The motor of claim 1, wherein said condensing means is means for condensing at least twenty-five percent of said gas into a liquid.

4. The motor of claim 1, wherein said condensing means is means for condensing at least fifty percent of said gas into a liquid.

5. The motor of claim 1, wherein said condensing means is means for condensing at least sixty percent of said gas into a liquid.

6. The motor of claim 1, further comprising a revolver to which said plate is coupled.

7. The motor of claim 1, further comprising means for expanding a gas within said housing in a manner which applies force to said plate.

8. The motor of claim 7, wherein said expanding means is an inlet directing said gas between said revolver and said housing toward said plate.

9. A motor comprising:

(a) a housing defining an expansion chamber and condensation chamber;

(b) a plate provided within said housing coupled for movement into fluid communication with said expansion chamber and said condensation chamber;

(c) means for assisting movement of said plate at least partially by expanding gas within said expansion chamber; and (d) means for cooling said condensation chamber sufficiently to produce at least ten percent of the energy used to generate movement of said plate at least partially by condensing at least a portion of said gas into a liquid within said condensation chamber.

10. The motor of claim 9, wherein said condensing means is means for cooling said gas at least ten degrees Celsius.

11. The motor of claim 9, wherein said condensing means is means for condensing at least twenty-five percent of said gas into a liquid.

12. The motor of claim 9, wherein said condensing means is means for condensing at least fifty percent of said gas into a liquid.

13. The motor of claim 9, wherein said condensing means is means for condensing at least sixty percent of said gas into a liquid.

14. The motor of claim 13, wherein said moving means is means for directing said gas between said revolver and said housing toward said plate.

15. A motor comprising:

(a) a wall defining an interior;

(b) a plurality of vanes coupled for rotation within said interior;

(c) means for directing a sufficient quantity of gas under pressure toward a vane of said plurality of vanes to assist in rotation movement of said vane; and (d) means for condensing a sufficient quantity of said gas to produce at least ten percent of the energy used to generate movement of said vane.

16. The motor of claim 15, wherein a first portion of said wall is provided with a first radius and wherein a second portion of said wall is provided with a second radius, wherein said first radius is greater than said second radius.

17. The motor of claim 15, further comprising a drum provided in said interior, wherein said plurality of vanes are coupled for movement relative to said drum.

18. The motor of claim 17, wherein said drum is provided with an exterior surface and wherein said drum is rotatably coupled within said interior for rotation between a first position, wherein said wall is closer to a first portion of said drum than a second portion of said drum, and a second position, wherein said wall is closer to a second portion of said drum than said first portion of said drum.

19. The motor of claim 17, further comprising means for extending said plurality of vanes relative to said drum.

20. The motor of claim 19, further comprising means for preventing said plurality of vanes from contacting said wall.

* * * * *